US009573371B2

(12) United States Patent
Hamaguchi et al.

(10) Patent No.: US 9,573,371 B2
(45) Date of Patent: Feb. 21, 2017

(54) HEAD AND LIQUID EJECTING APPARATUS

(71) Applicant: SEIKO EPSON CORPORATION, Tokyo (JP)

(72) Inventors: Toshiaki Hamaguchi, Fujimi-machi (JP); Eiju Hirai, Minowa-machi (JP); Yoichi Naganuma, Matsumoto (JP); Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/014,071

(22) Filed: Feb. 3, 2016

(65) Prior Publication Data

US 2016/0263889 A1 Sep. 15, 2016

(30) Foreign Application Priority Data

Mar. 10, 2015 (JP) ..... 2015-047547

(51) Int. Cl.
*B41J 2/335* (2006.01)
*B41J 2/14* (2006.01)

(52) U.S. Cl.
CPC ..... *B41J 2/14201* (2013.01); *B41J 2/33595* (2013.01); *B41J 2/14032* (2013.01); *B41J 2002/14491* (2013.01)

(58) Field of Classification Search
CPC . B41J 2/14201; B41J 2/33595; B41J 2/14032; B41J 2002/14491
See application file for complete search history.

(56) References Cited

U.S. PATENT DOCUMENTS

2003/0173597 A1* 9/2003 Kamiya ..... H01L 23/5258 257/209
2006/0290747 A1* 12/2006 Shimada ..... B41J 2/14233 347/68
2009/0309242 A1* 12/2009 Mizuno ..... B41J 2/14233 257/786
2011/0169897 A1* 7/2011 Yokoyama ..... B41J 2/055 347/70
2012/0229554 A1* 9/2012 Goto ..... B41J 2/14024 347/20

FOREIGN PATENT DOCUMENTS

JP 2014-051008 A 3/2014

* cited by examiner

*Primary Examiner* — Manish S Shah
*Assistant Examiner* — Yaovi M Ameh
(74) *Attorney, Agent, or Firm* — Workman Nydegger

(57) ABSTRACT

Provided is a head including a channel formation substrate that is provided with a pressure generating chamber which communicates with a nozzle for ejecting a liquid, a piezo element, a driving circuit board that is bonded to the one surface side of the channel formation substrate, and a driving circuit for driving the piezo element. The piezo element and the driving circuit are electrically connected to each other via a bump which is provided on any one of the channel formation substrate and the driving circuit board. A holding portion that holds the piezo element is provided between the driving circuit board and the channel formation substrate. The holding portion is opened to an atmosphere through an atmosphere open passage which is provided to penetrate the driving circuit board in a direction in which the driving circuit board and the channel formation substrate are stacked.

10 Claims, 8 Drawing Sheets

HEAD AND LIQUID EJECTING APPARATUS

CROSS-REFERENCE TO RELATED APPLICATIONS

The present application claims priority to Japanese Patent Application No. 2015-047547 filed on Mar. 10, 2015, which is hereby incorporated by reference in its entirety.

BACKGROUND

1. Technical Field

The present invention relates to a head which ejects a liquid, and a liquid ejecting apparatus which is provided with the head, and particularly relates to an ink jet recording head and an ink jet type recoding apparatus which eject ink as the liquid.

2. Related Art

A piezo ink jet system is an on-demand type ink jet printing system which discharges a liquid droplet by deforming a piezo element through the applying of a voltage to the piezo element (JIS Z8123-1: 2013).

A permanent head is a machine portion or an electrical portion of a printer main body which continuously or intermittently generates a liquid droplet of ink (JIS Z8123-1: 2013).

The permanent head (hereinafter, referred to as a "head") which is used in the piezo ink jet system is provided with a channel formation substrate on which a pressure generating chamber, which communicates with a nozzle for ejecting a liquid droplet is formed, a piezo element which is provided on one surface side of the channel formation substrate, and a driving circuit board in which a driving circuit, which is bonded onto the channel formation substrate so as to be close to the piezo element and drives the piezo element is provided. The permanent head ejects the liquid droplet from the nozzle by driving the piezo element by the driving circuit and applying a pressure change to the liquid in the pressure generating chamber.

As the piezo element described above, a thin-film type piezo element which is formed on the channel formation substrate through a film formation method and a lithography method has been proposed. When using such a thin-film type piezo element, it is possible to dispose the piezo element at high density; however, it is difficult to electrically connect the piezo element which is disposed at high density and the driving circuit.

For this reason, there have been suggested a configuration such that a bump is provided on the driving circuit board, and the driving circuit and the piezo element are electrically connected to each other via the bump (for example, JP-A-2014-51008).

In this way, by using the bump for connection between the driving circuit and the piezo element, it is possible to easily connect the piezo element which is disposed at high density and the driving circuit at low cost.

However, there is a problem in that if a holding portion, which is a space for accommodating a piezo element, between the driving circuit board and the channel formation substrate is sealed, a pressure change in the holding portion is generated by the driving of the piezo element, and thus the displacement of the piezo element is disturbed due to the pressure change in the holding portion. In addition, if the holding portion is sealed, the pressure of a gas in the holding portion changes due to a temperature change, the displacement of the piezo element is disturbed due to the pressure change in the holding portion, a membrane for separating the holding portion from a flow path is destroyed, ink flows into the holding portion from the flow path, and thereby the piezo element may be destroyed due to the inflowing ink.

In addition, there is a problem in that if the holding portion is sealed, at the time of bonding the driving circuit board and the channel formation substrate, moisture contained in the atmosphere is sealed, and becomes condensation at a low temperature such that the moisture is attached to the piezo element, thereby destroying the piezo element.

Note that such a problem exists in not only a head for ejecting ink, but also a head for ejecting liquid droplets other than the ink.

SUMMARY

An advantage of some aspects of the invention is to provide a head and liquid ejecting apparatus which prevents displacement of a piezo element from being disturbed such that the piezo element is not easily destroyed.

According to an aspect of the invention, there is provided a head including a channel formation substrate that is provided with a pressure generating chamber which communicates with a nozzle for ejecting a liquid; a piezo element that is provided on one surface side of the channel formation substrate; and a driving circuit board that is bonded to the one surface side of the channel formation substrate via an adhesive layer, and is provided with a driving circuit for driving the piezo element, in which the piezo element and the driving circuit are electrically connected to each other via a bump which is provided on any one of the channel formation substrate and the driving circuit board, a holding portion which is surrounded by the adhesive layer and holds the piezo element therein is provided between the driving circuit board and the channel formation substrate, and the holding portion is opened to an atmosphere through an atmosphere open passage which is provided to penetrate the driving circuit board in a direction in which the driving circuit board and the channel formation substrate are stacked.

According to the aspect, it is possible to ensurely connect the piezo element which is disposed at high density and the driving circuit via the bump at low cost. In addition, when the holding portion is opened to an atmosphere through the atmosphere open passage which is provided on the driving circuit board, it is possible to prevent the pressure in the holding portion from being changed, to prevent the displacement of the piezo element from being disturbed, and to prevent a membrane for separating the holding portion from a flow path from being destroyed. In addition, the atmosphere open passage is not provided on the adhesive layer, and thus it is possible to prevent bonding strength from being weakened, and to prevent a liquid from flowing into the holding portion via the atmosphere open passage.

Here, it is preferable that a metal wiring is provided over the periphery of the atmosphere open passage in at least a portion in the driving circuit board in which the driving circuit is provided. With this, it is possible to prevent the moisture from flowing into the driving circuit from an inner wall surface of the atmosphere open passage by the metal wiring.

In addition, it is preferable that the adhesive layer is formed of a photosensitive resin. With this, it is possible to easily form the adhesive layer in a predetermined shape with high accuracy.

In addition, it is preferable that the bump includes a core portion having elastic properties, and a metallic film which is provided on a surface of the core portion. With this, even when the warpage and undulation occur on the driving circuit board or the channel formation substrate, the core portion of the bump is deformed in accordance with the warpage and undulation, and thus it is possible to ensurely connect the bump and the piezo element.

According to another aspect of the invention, there is provided a liquid ejecting apparatus including the head described in the above-described aspects.

According to the aspect, it is possible to prevent the displacement of the piezo element from being disturbed, thereby realizing the liquid ejecting apparatus which suppresses the destruction of the piezo element.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described in detail.

Embodiment 1

Figure 1:
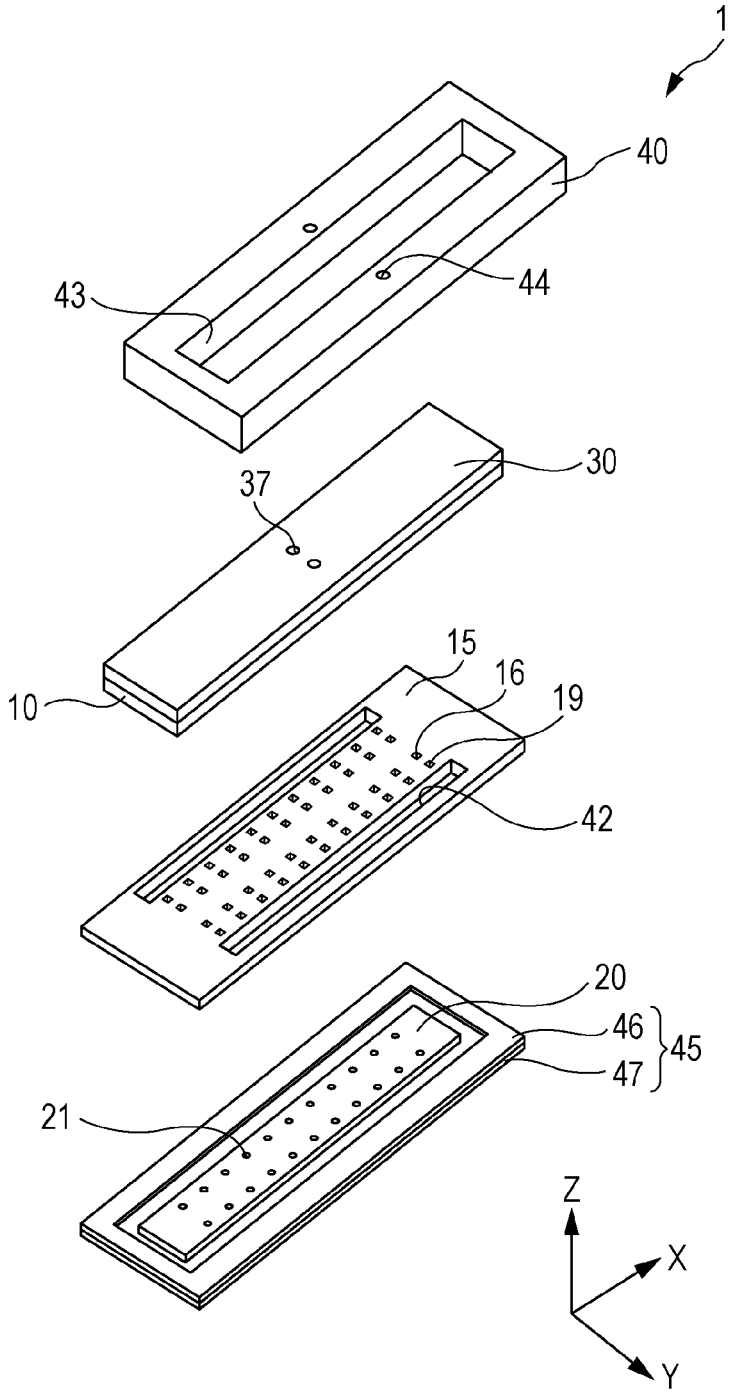
FIG. 1 is an exploded perspective view of a head according to Embodiment 1.
Figure 2:
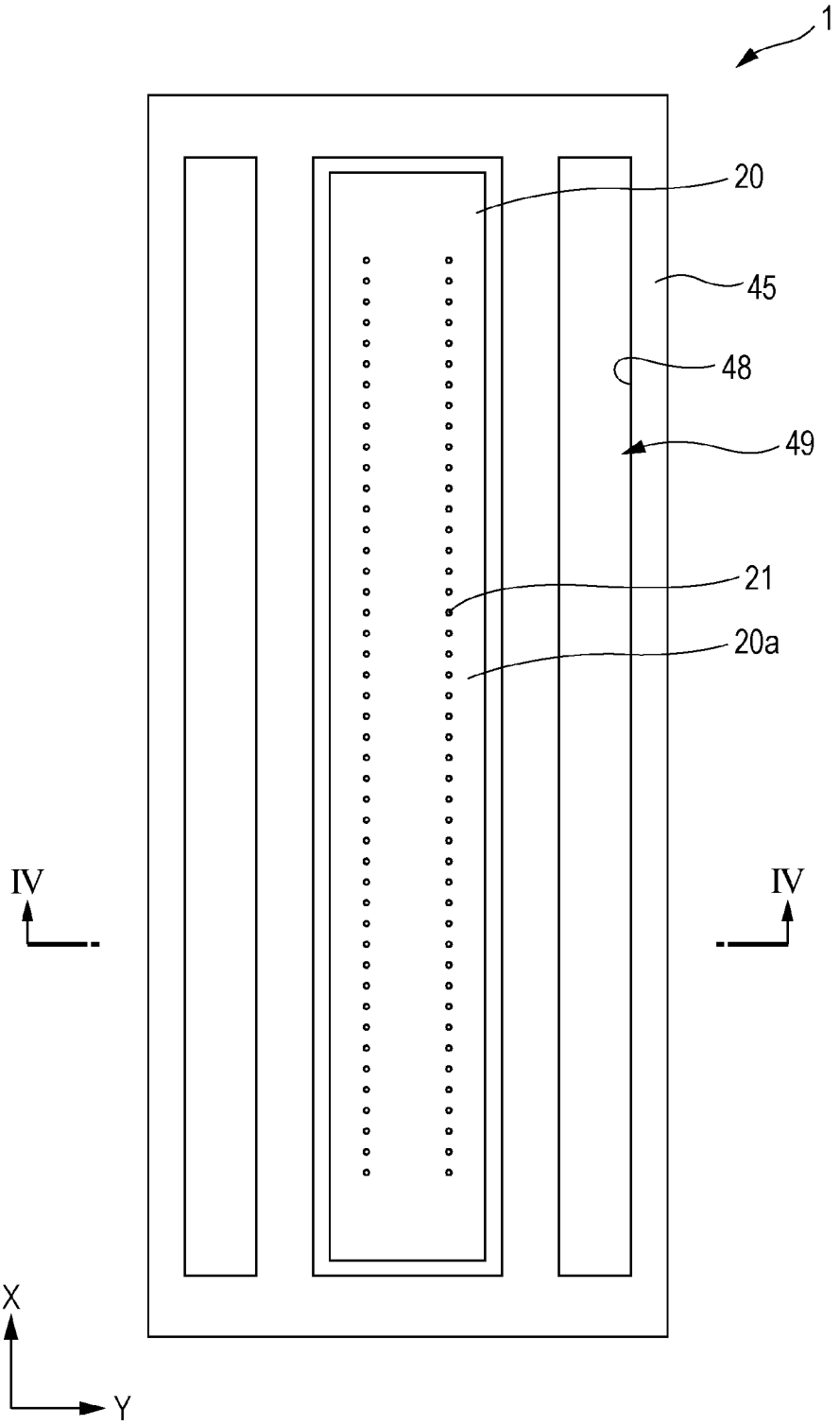
FIG. 2 is a plan view of the head according to Embodiment 1.
Figure 3:
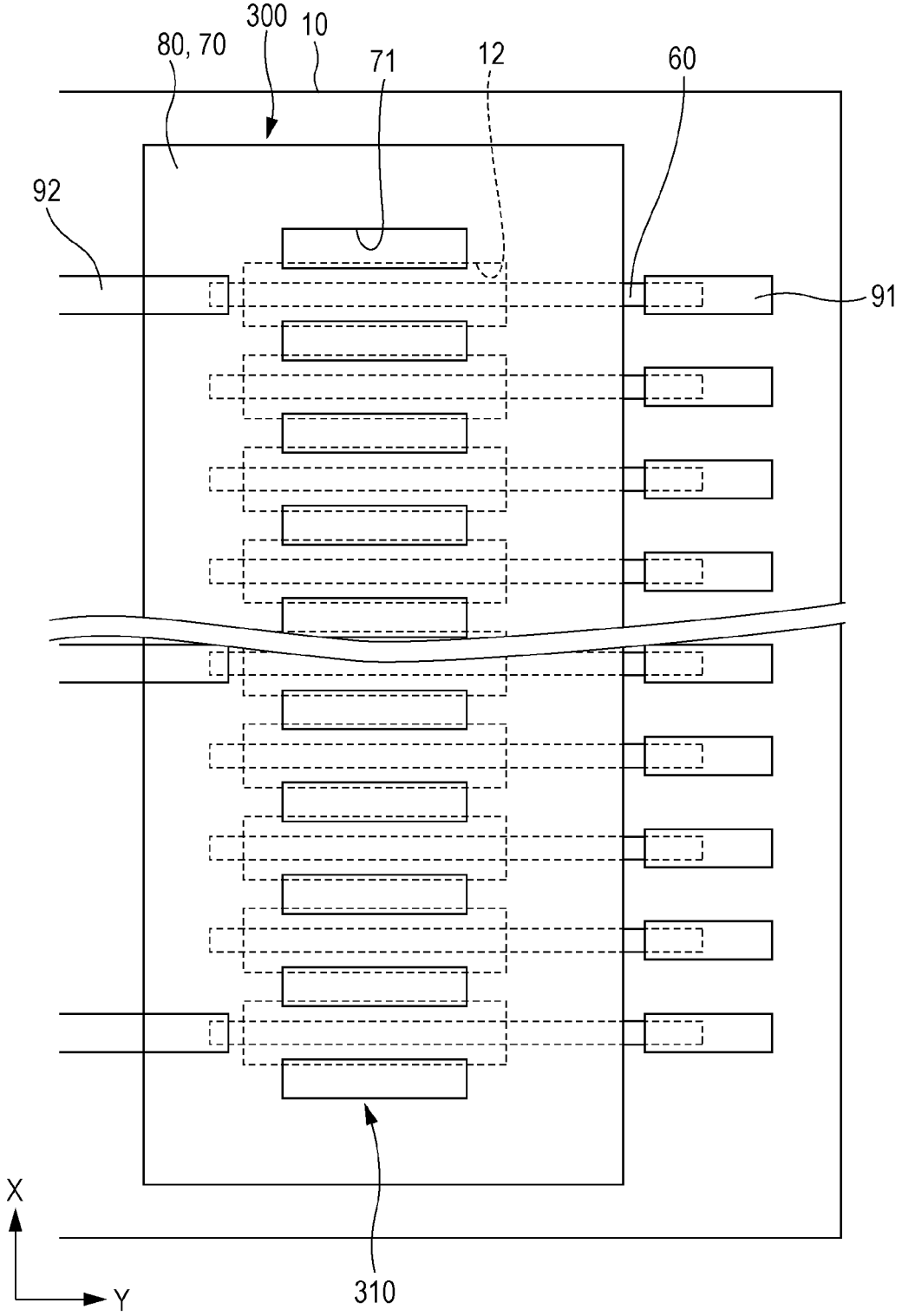
FIG. 3 is a plan view illustrating a main portion of a channel formation substrate according to Embodiment 1.
Figure 4:
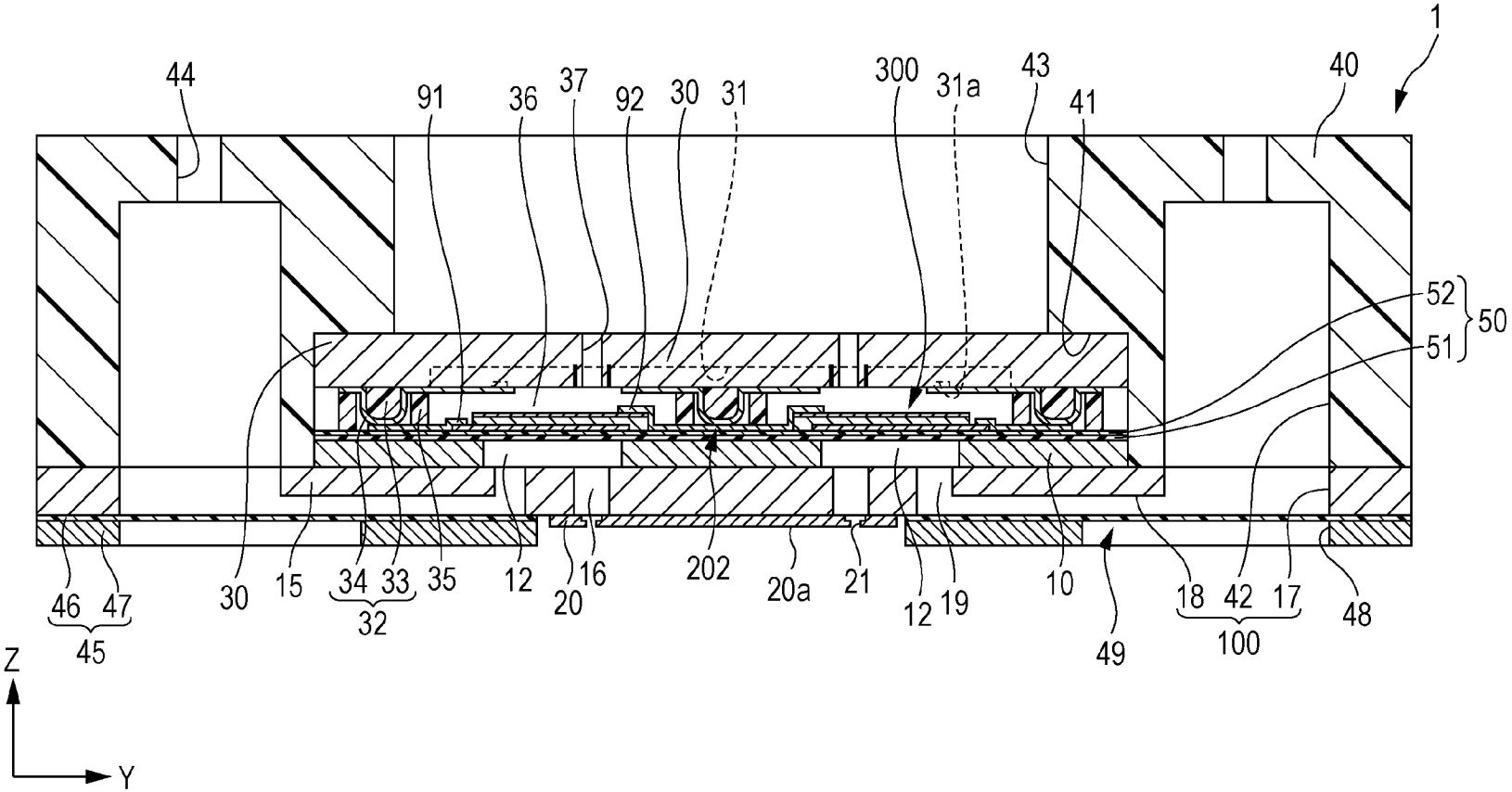
FIG. 4 is a sectional view of the head according to Embodiment 1.
Figure 5:
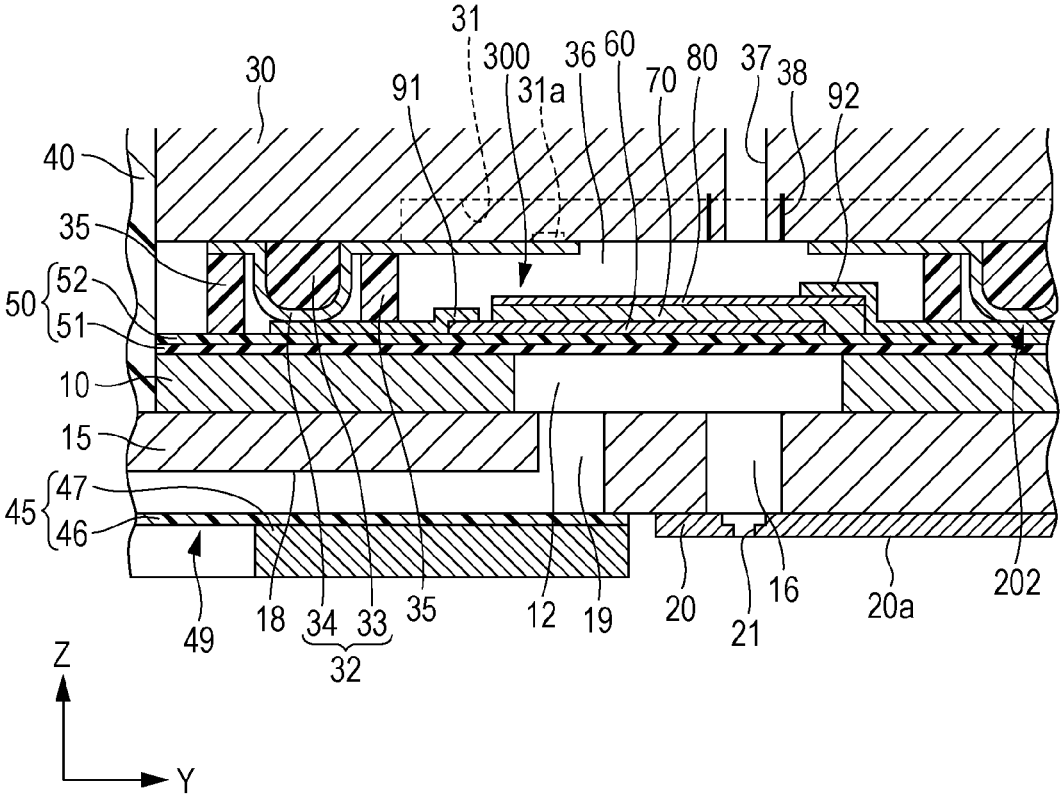
FIG. 5 is an enlarged sectional view illustrating a main portion of the head according to Embodiment 1.

FIG. 1 is an exploded perspective view of an ink jet recording head which is an example of a head according to the Embodiment 1, FIG. 2 is a plan view of the ink jet recording head. In addition, FIG. 3 is a plan view of a main portion of a channel formation substrate, FIG. 4 is a sectional view taken along line IV-IV in FIG. 2, and FIG. 5 is an enlarged sectional view of a main portion of FIG. 4.

As illustrated in the drawings, the ink jet recording head 1 which is an example of the head in the embodiment is provided with a plurality of members such as a channel formation substrate 10, a communicating plate 15, a nozzle plate 20, a driving circuit board 30, and a compliance board 45.

The channel formation substrate 10 can be formed of, for example, metal such as a stainless steel or Ni, a ceramic material such as $ZrO_2$ or $Al_2O_3$, a glass ceramic material, and an oxide such as an oxide MgO and $LaAlO_3$. In the embodiment, the channel formation substrate 10 is formed of a silicon single crystal substrate. As illustrated in FIG. 4 and FIG. 5, by performing anisotropic etching to the channel formation substrate 10 from one surface side, pressure generating chambers 12 which are partitioned off by a plurality of partition walls are arranged along a direction in which a plurality of nozzles 21 which discharge ink are arranged. Hereinafter, the aforementioned direction is referred to as a juxtaposing direction of the pressure generating chambers 12, or a first direction X. In addition, on the channel formation substrate 10, a plurality of rows of the pressure generating chambers 12 are arranged in the first direction X, and two rows are provided in the embodiment. Hereinafter, a row direction in which a plurality of rows of the pressure generating chambers 12 formed along the first direction X is referred to as a second direction Y. In addition, a direction intersecting with the first direction X and the second direction Y is referred to as a third direction Z in the embodiment. Note that, the directions (X, Y, and Z) are set to be orthogonal to each other in the embodiment; however, components are not limited to be orthogonally disposed.

In addition, on the channel formation substrate 10, for example, a supply path which is smaller than an opening area of the pressure generating chamber 12 and applies a channel resistance to ink flowing into the pressure generating chamber 12 may be provided at one end portion of the pressure generating chamber 12 in the second direction Y.

In addition, on one surface side of the channel formation substrate 10 (a lamination layer direction (a −Z direction)), the communicating plate 15 and the nozzle plate 20 are sequentially laminated. That is, the communicating plate 15 is provided on the one surface of the channel formation substrate 10, and a nozzle plate 20 having nozzles 21 is provided on the surface side opposite to side of the channel formation substrate 10 on which the communicating plate 15 is provided.

The communicating plate 15 is provided with a nozzle communicating path 16 through which the pressure generating chamber 12 and the nozzle 21 communicate with each other. The communicating plate 15 has a larger area than the channel formation substrate 10, and the nozzle plate 20 has a smaller area than the channel formation substrate 10. With such a communicating plate 15 being provided, the nozzle 21 of the nozzle plate 20 and the pressure generating chamber 12 can be separated from each other, and thus the ink in the pressure generating chamber 12 is less likely to be susceptible of thickening due to evaporation of water in the ink occurring in the vicinity of the nozzle 21. In addition, the nozzle plate 20 may only cover openings in the nozzle communicating path 16 through which the pressure generating chamber 12 and the nozzle 21 communicate with each other, and thus it is possible to relatively reduce the area of the nozzle plate 20, and thereby to realize the cost reduction. In addition, in the embodiment, a surface from which is an ink droplet is discharged by opening the nozzle 21 of the nozzle plate 20 is referred to as a liquid ejection surface 20*a*.

In addition, the communicating plate 15 is provided with a first manifold portion 17 and a second manifold portion 18 which form a portion of a manifold 100.

The first manifold portion 17 is provided by passing through the communicating plate 15 in a thickness direction (a direction in which the communicating plate 15 and the channel formation substrate 10 are laminated).

In addition, the second manifold portion 18 is provided by being opened to the nozzle plate 20 side of the communicating plate 15 without passing through the communicating plate 15 in the thickness direction.

In addition, on the communicating plate 15, a supply communicating path 19 which communicates with one end portion of the pressure generating chamber 12 in the second direction Y is independently provided for each pressure generating chamber 12. The second manifold portion 18 and the pressure generating chamber 12 communicate with each other through the supply communicating path 19.

Such a communicating plate 15 can be formed of metal such as a stainless steel or Ni, or ceramics such as zirconium. In addition, the communicating plate 15 is preferably formed of a material having the same linear expansion coefficient as that of the channel formation substrate 10. That is, in a case where a material having a different linear expansion coefficient different from that of the channel formation substrate 10 is used as the communicating plate 15, when heating and cooling the communicating plate 15, a warpage is likely to occur on the communicating plate 15 due to a difference of the linear expansion coefficient between the channel formation substrate 10 and the communicating plate 15. The embodiment is configured such that it is possible to suppress the occurrence of warpage by being heated and cooled, cracks due to heat, or peeling by using a material which is the same as that of the channel formation substrate 10, that is, a silicon single crystal substrate, as the communicating plate 15.

The nozzle 21 which communicates with each of the pressure generating chambers 12 through the nozzle communicating path 16 is formed on the nozzle plate 20. Such nozzles 21 are arranged in the first direction X, and two rows of the nozzles 21, each of which is formed of the nozzles 21 arranged in the first direction X, are formed in the second direction Y.

As such a nozzle plate 20, it is possible to use, for example, metal such as a stainless steel (SUS), an organic material such as a polyimide resin, and a silicon single crystal substrate. In addition, when using the silicon single crystal substrate as the nozzle plate 20, the linear expansion coefficient between the nozzle plate 20 and the communicating plate 15 is the same, and thus it is possible to suppress the occurrence of the warpage by being heated and cooled, cracks due to heat, or peeling.

On the other hand, a vibrating plate 50 is formed on the surface side opposite to side of the channel formation substrate 10 on which the communicating plate 15 is provided. In the embodiment, as the vibrating plate 50, an elastic film 51 which is provided on the channel formation substrate 10 side and is formed of a silicon oxide and an insulator film 52 which is provided on the elastic film 51, and is formed of a zirconium oxide. In addition, a liquid flow path such as the pressure generating chamber 12 is formed by performing the anisotropic etching on the channel formation substrate 10 from one surface side (from the surface to which the nozzle plate 20 is bonded) of the liquid flow path, and the other surface of the liquid flow path such as the pressure generating chamber 12 is partitioned by the elastic film 51.

In addition, a piezoelectric actuator 300 which is a piezo element of the embodiment is provided on the vibrating plate 50 of the channel formation substrate 10. The piezoelectric actuator 300 includes a first electrode 60, a piezoelectric layer 70, and a second electrode 80 which are sequentially laminated from the vibrating plate 50 side. As illustrated in FIG. 3, the first electrodes 60 which form the piezoelectric actuator 300 are cut and divided for each pressure generating chamber 12 so as to form an individual electrode for each piezoelectric actuator 300. In the embodiment, the first electrode 60 is cut and divided for each pressure generating chamber 12 so as to form the individual electrode for each active portion which is a substantial driving portion of the piezoelectric actuator 300. Such a first electrode 60 is formed with a smaller width than the pressure generating chamber 12 in the first direction X of the pressure generating chamber 12. That is, in the first direction X of the pressure generating chamber 12, an end portion of the first electrode 60 is positioned on the inner side of an area facing the pressure generating chamber 12. In addition, in the second direction Y of the pressure generating chamber 12, each of both end portions of the first electrode 60 is extended to the outside of the pressure generating chamber 12. A material of such a first electrode 60 is not limited as long as it is a metallic material, and for example, platinum (Pt) and iridium (Ir) are preferably used.

The piezoelectric layer 70 is continuously provided in the first direction X such that the second direction Y becomes a predetermined width. The width of the piezoelectric layer 70 in the second direction Y is larger than the width of the pressure generating chamber 12 in the second direction Y. For this reason, in the second direction Y of the pressure generating chamber 12, the piezoelectric layer 70 is extended to the outside of the pressure generating chamber 12.

An end portion of the piezoelectric layer 70 on one end portion side (the side opposite to the manifold 100) of the pressure generating chamber 12 in the second direction Y is positioned on the outside from the end portion of the first electrode 60. That is, the end portion of the first electrode 60 is covered with the piezoelectric layer 70. In addition, an end portion of the piezoelectric layer 70 on the other end side of the pressure generating chamber 12 in the second direction Y which is the manifold 100 side is positioned on the inner side from the end portion of the first electrode 60 (the pressure generating chamber 12 side), and the end portion of the first electrode 60 on the manifold 100 side is not covered with the piezoelectric layer 70.

The piezoelectric layer 70 is formed of a piezoelectric material such as an oxide having a polarization structure which is formed on the first electrode 60, and can be formed of, for example, a perovskite type oxide expressed by a general formula of $ABO_3$. As the perovskite type oxide used for the piezoelectric layer 70, for example, a lead based piezoelectric material including lead or a non-lead based piezoelectric material which does not include the lead can be used.

Such a piezoelectric layer 70 is provided with a recessed portion 71 corresponding to each partition wall. The width of the recessed portion 71 in the first direction X is substantially the same as or larger than the width of each partition wall in the first direction X. With this, rigidity of a portion (a so-called arm portion of the vibrating plate 50) corresponding to the end portion of the pressure generating chamber 12 in the second direction Y of the vibrating plate 50 is suppressed, and thus the piezoelectric actuator 300 can be favorably displaced.

The second electrode 80 is provided on the surface opposite to the surface of the piezoelectric layer 70 on which the first electrode 60 is provided, and forms a common electrode which is common to a plurality of the active portions. In addition, the second electrode 80 may be or may be not formed on the inner surface of the recessed portion 71, that is, on the surface side of the recessed portion 71 of the piezoelectric layer 70.

The piezoelectric actuator 300 which is formed of the first electrode 60, the piezoelectric layer 70, and the second electrode 80 is displaced by applying a voltage between the first electrode 60 and the second electrode 80. That is, when the voltage is applied between both electrodes, piezoelectric strain occurs in the piezoelectric layer 70 which is pinched between the first electrode 60 and the second electrode 80. In addition, at the time of applying the voltage to both electrodes, a portion of the piezoelectric layer 70 in which the piezoelectric strain occurs is referred to as an active portion. In contrast, a portion of the piezoelectric layer 70 in which the piezoelectric strain does not occur is referred to as a non-active portion.

As illustrated in FIGS. 3, 4, and 5, an individual wiring 91 which is a lead-out wiring is drawn out from the first electrode 60 of the piezoelectric actuator 300. In the embodiment, two rows of the piezoelectric actuator 300 (the active portion), each of which is formed of the piezoelectric actuator 300 arranged in the first direction X are provided in the second direction Y, and the individual wiring 91 is drawn from each row of the piezoelectric actuator 300 to the outside of the row in the second direction Y. In addition, a common wiring 92 which is the lead-out wiring is drawn out from the second electrode 80 of the piezoelectric actuator 300. In the embodiment, the common wiring 92 is electrically connected to the second electrode 80 in each of the two rows of the piezoelectric actuator 300. In addition, one common wiring 92 is provided with respect to the plurality of active portions.

The driving circuit board 30 having substantially the same size as that of the channel formation substrate 10 is bonded onto the surface of the piezoelectric actuator 300 side of the channel formation substrate 10.

Figure 6:
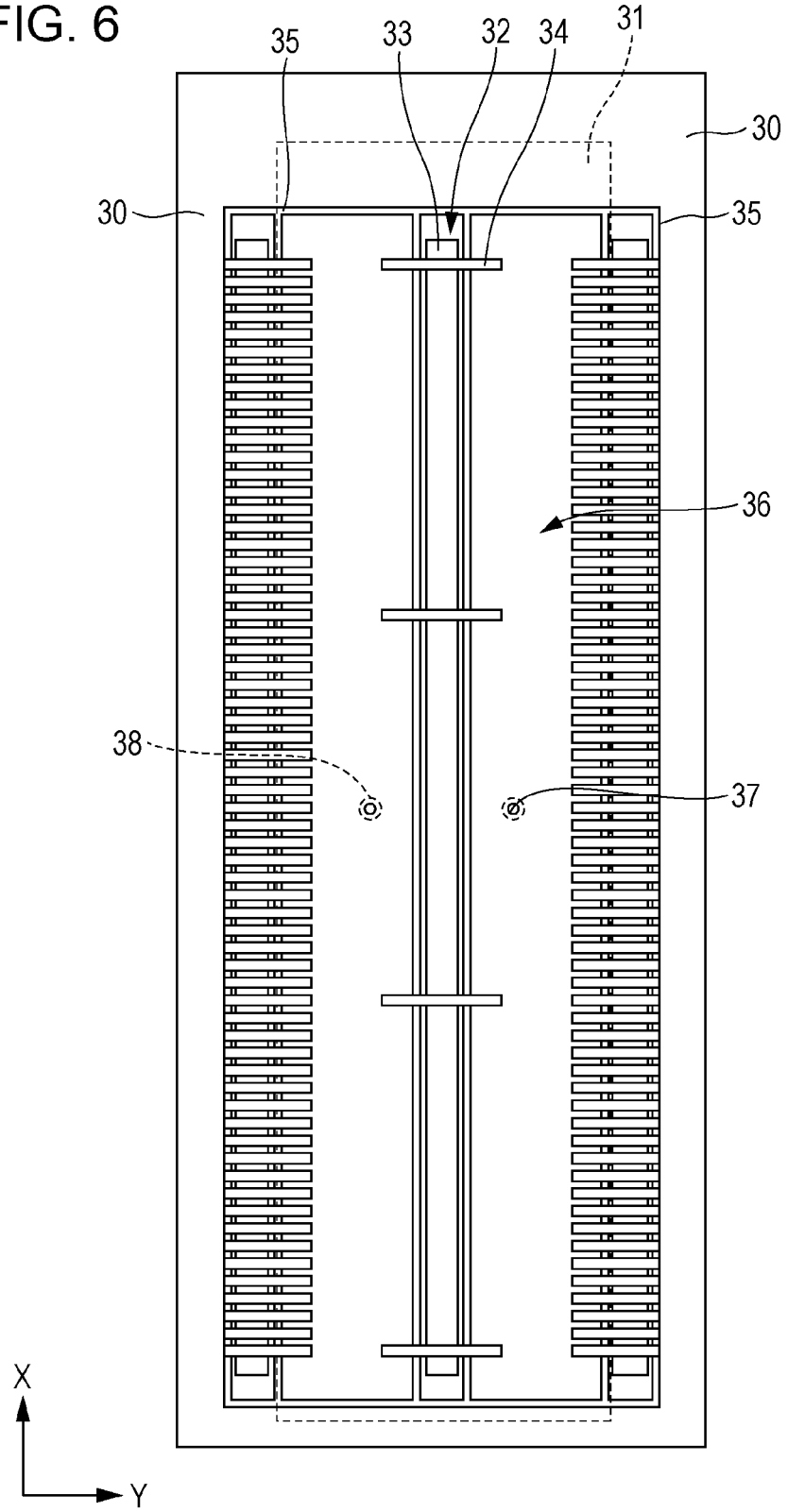
FIG. 6 is a plan view of the driving circuit board according to Embodiment 1.

Here, the driving circuit board 30 will be described with reference to FIG. 4, FIG. 5, and FIG. 6. Meanwhile, FIG. 6 is a plan view of a driving circuit board according to the Embodiment 1.

As illustrated in the drawings, the driving circuit board 30 in the embodiment is obtained by forming the driving circuit 31 which is an integrated circuit on the semiconductor substrate through a semiconductor manufacturing process, for example, the driving circuit board 30 is not obtained by being mounted on the wiring with a semiconductor integrated circuit being provided on the substrate.

Such a driving circuit board 30 is integrally formed on the surface side on which the driving circuit 31 and the channel formation substrate 10 face each other. In addition, the driving circuit board 30 and the channel formation substrate 10 are bonded to each other via an adhesive layer 35.

Here, the driving circuit 31 of the driving circuit board 30 and the individual wiring 91 and the common wiring 92 of the channel formation substrate 10 are connected to each other via the bump 32. In the embodiment, the bump 32 which is electrically connected to each terminal 31*a* of the driving circuit 31 is provided on the surface of the driving circuit board 30, which is opposite to the surface facing the channel formation substrate 10, the bump 32, and the individual wiring 91 and the common wiring 92 are electrically connected to each other via the bump 32, and thus the driving circuit 31, and the first electrode 60 and the second electrode 80 of the piezoelectric actuator 300 are electrically connected to each other.

Such a bump 32 is provided with, for example, a core portion 33 which is formed of a resin material having elastic properties, and a metallic film 34 which is formed on the surface of the core portion 33.

The core portion 33 is formed of a photosensitive insulating resin or a thermosetting insulating resin such as a polyimide resin, an acrylic resin, a phenol resin, a silicone resin, a silicone-modified polyimide resin, and an epoxy resin.

In addition, the core portion 33 is formed into a substantially semispherical shape before the driving circuit board 30 and the channel formation substrate 10 are bonded to each other. Here, the semispherical shape means a columnar shape of which an inner surface (a bottom surface) coming in contact with the driving circuit board 30 is a flat surface and an outer surface side which is a non-contact surface is a curved surface. Specifically, the substantially semispherical shape includes a case where a cross-section is formed into a substantially semicircle shape, a substantially semielliptical shape, or a substantially trapezoid shape.

In addition, when the core portion 33 is compressed such that the driving circuit board 30 and the channel formation substrate 10 are relatively close to be each other, a distal end shape thereof is elastically deformed as the surface shape of the individual wiring 91 and the common wiring 92.

With this, even though the warpage and undulation occur on the driving circuit board 30 or the channel formation substrate 10, the core portion 33 is deformed in accordance with the warpage and undulation, and the bump 32, and the individual wiring 91 and the common wiring 92 can be surely connected to each other.

In addition, in the embodiment, the core portion 33 is continuously disposed in a linear manner in the first direction X. That is, in addition, total of three core portions 33 are provided in such a manner that two core portions 33 are provided on the outside of two rows of piezoelectric actuator 300, and one core portion 33 is provided between two rows of piezoelectric actuator 300 in the second direction Y. Further, each of the core portions 33 which are provided on the outside of the two rows of piezoelectric actuator 300 forms the bump 32 connected to the individual wiring 91 of the row of piezoelectric actuator 300, and the core portion 33 which is provided between two rows of piezoelectric actuator 300 forms the bump 32 connected to the common wiring 92 of the two rows of piezoelectric actuator 300.

Such a core portion 33 can be formed by using photolithography technique and etching technique.

The metallic film 34 covers the surface of the core portion 33. The metallic film 34 is formed of metal, for example, Au, TiW, Cu, Cr (chrome), Ni, Ti, W, NiV, Al, Pd (palladium), and a lead-free solder, or an array, and these may be a single layer or a multiple layer. In addition, the metallic film 34 is deformed as the surface shape of the individual wiring 91 and the common wiring 92 due to the elastically deformed core portion 33, and is metallically bonded to the individual wiring 91 and the common wiring 92. In addition, the metallic film 34 which is connected to the individual wiring 91 is provided on the surface of the core portion 33 at the same pitch as that of the individual wiring 91 in the first direction X. In addition, the metallic film 34 which is connected to the common wiring 92 is provided on the surface of the core portion 33 at the same pitch as that of the common wiring 92 in the first direction X.

Such a bump 32, in the embodiment, the metallic film 34 which is provided on the surface of the core portion 33, and the individual wiring 91 and the common wiring 92 are bonded to each other at a normal temperature. Specifically, the driving circuit board 30 and the channel formation substrate 10 in the embodiment are bonded to each other via the adhesive layer 35, and the bump 32, and the individual wiring 91 and the common wiring 92 are fixed to each other while coming in contact with each other. Here, examples of the adhesive layer 35 include an adhesive or a resist material such as an epoxy resin, an acrylic resin, and a silicone resin. Particularly, it is possible to easily form the adhesive layer 35 with high accuracy by using the photosensitive resin used in a photoresist or the like.

In the embodiment, the adhesive layer 35 is provided on the both sides of each bump 32, that is, on the both sides with the bump 32 interposed therebetween in the second direction Y. That is, three bumps 32, each of which is extended in the first direction X, are provided in the second direction Y, and thus the adhesive layer 35 is extended on the both sides of each bump 32 in the second direction Y along the first direction X. That is, six adhesive layers 35, each of which is extended in the first direction X, are provided in the second direction Y. In addition, the adhesive layers 35 which are arranged in the second direction Y are provided such that end portions thereof are continuous at both end portions in the first direction X. That is, the adhesive layer 35 is formed so as to cover around each row of the piezoelectric actuator 300, and is formed into a rectangular frame shape so as to surround each row of the piezoelectric actuator 300 in a planar view.

As described above, a holding portion 36 which is a space in which the piezoelectric actuator 300 is disposed is formed between the channel formation substrate 10 and the driving circuit board 30 by the adhesive layer 35 bonding the channel formation substrate 10 and the driving circuit board 30. In the embodiment, the adhesive layer 35 is continuously provided to cover around each row of the piezoelectric actuator 300, and thus the holding portion 36 corresponding to each row of the piezoelectric actuator 300 is independently provided between the channel formation substrate 10 and the driving circuit board 30.

In addition, such a holding portion 36 communicates with the outside, that is, is opened to an atmosphere through an atmosphere open passage 37 which is provided to penetrate the driving circuit board 30 in a third direction Z in which the driving circuit board 30 and the channel formation substrate 10 are stacked. In the embodiment, since two holding portions 36 are provided between the channel formation substrate 10 and the driving circuit board 30, one atmosphere open passage 37 is provided for each of the holding portions 36.

In addition, regarding the atmosphere open passage 37, a cross-section, that is, an opening shape may be a rectangular shape or may be a circular shape. In addition, the atmosphere open passage 37 may be linearly provided along the third direction Z, or may be obliquely provided with respect to the third direction Z. In addition, the atmosphere open passage 37 may be formed by combining a portion which is linearly provided along the third direction Z, and a portion which is obliquely provided with respect to the third direction Z.

As described above, the holding portion 36, which is a space for holding the piezoelectric actuator 300, between the channel formation substrate 10 and the driving circuit board 30 is opened to an atmosphere through an atmosphere open passage 37 which is provided to penetrate the driving circuit board 30. For this reason, it is possible to prevent that the holding portion 36 is sealed is sealed, a pressure change in the holding portion 36 is generated by the driving of the piezoelectric actuator 300, and thus the displacement of the piezoelectric actuator 300 is disturbed. That is, when the holding portion 36 is opened to the atmosphere, it is possible to prevent the pressure in the holding portion 36 from being changed due to the driving of the piezoelectric actuator 300, to prevent the displacement of the piezoelectric actuator 300 from being disturbed. In addition, if the holding portion 36 is sealed, at the time of bonding the driving circuit board 30 and the channel formation substrate 10, moisture contained in the atmosphere is sealed in the holding portion 36, and becomes condensation at a low temperature such that the moisture is attached to the piezoelectric actuator 300, thereby destroying the piezoelectric actuator 300. In the embodiment, when the holding portion 36 is open to the atmosphere, it is possible to prevent the atmosphere containing the moisture in the holding portion 36 from being sealed, and thereby to suppress the destruction of the piezoelectric actuator 300 due to water drops attached to the piezoelectric actuator 300. Further, there is a concern in that if the holding portion 36 is sealed, the atmosphere in the holding portion 36 expands or contracts due to the temperature change, and thus the displacement of the piezoelectric actuator 300 is disturbed, and a membrane for separating the holding portion 36 from a flow path, in the embodiment, the vibrating plate 50 is destroyed. In the embodiment, by opening the holding portion 36 to the atmosphere, it is possible to suppress the pressure change in the holding portion 36 even though the atmosphere in the holding portion 36 expands or contracts, and to prevent the displacement of the piezoelectric actuator 300 from being disturbed, to prevent the vibrating plate 50 or the like from being destroyed, and to prevent the piezoelectric actuator 300 from being destroyed due to ink which flows into the holding portion 36 from the pressure generating chamber 12.

In addition, when the adhesive layer 35 is discontinuously provided in the periphery of the row of the piezoelectric actuator 300, it is considered that a discontinuous portion of the adhesive layer 35 may be firstly opened to the atmosphere; however, the bonding strength between the channel formation substrate 10 and the driving circuit board 30 is deteriorated, and reliability of the connection between the bump 32, and the individual wiring 91 and the common wiring 92 is deteriorated. In addition, in a case where the discontinuous portion of the adhesive layer 35 is firstly opened to the atmosphere, the atmosphere open passage is required to be separately formed between a case member 40, which is specifically described below, and the driving circuit board 30, and thus a structure becomes complicated and ink may flow into the holding portion 36 from discontinuous portion of the adhesive layer 35, which is not preferable. In the embodiment, the adhesive layer 35 is continuously provided around the row of the piezoelectric actuator 300, and the holding portion 36 which is formed by the adhesive layer 35 is opened on the side of the driving circuit board 30 opposite to the channel formation substrate 10 through the atmosphere open passage 37 which is provided to penetrate the driving circuit board 30, and thus the bonding strength between the channel formation substrate 10 and the driving circuit board 30 is enhanced. Therefore, it is possible to improve the reliability of the connection between the bump 32, and the individual wiring 91 and the common wiring 92. In addition, it is less likely that the moisture such as ink flows into the holding portion 36 via the atmosphere open passage 37, and thus it is possible to prevent the piezoelectric actuator 300 from being destroyed due to the moisture such as the ink.

Figure 7:
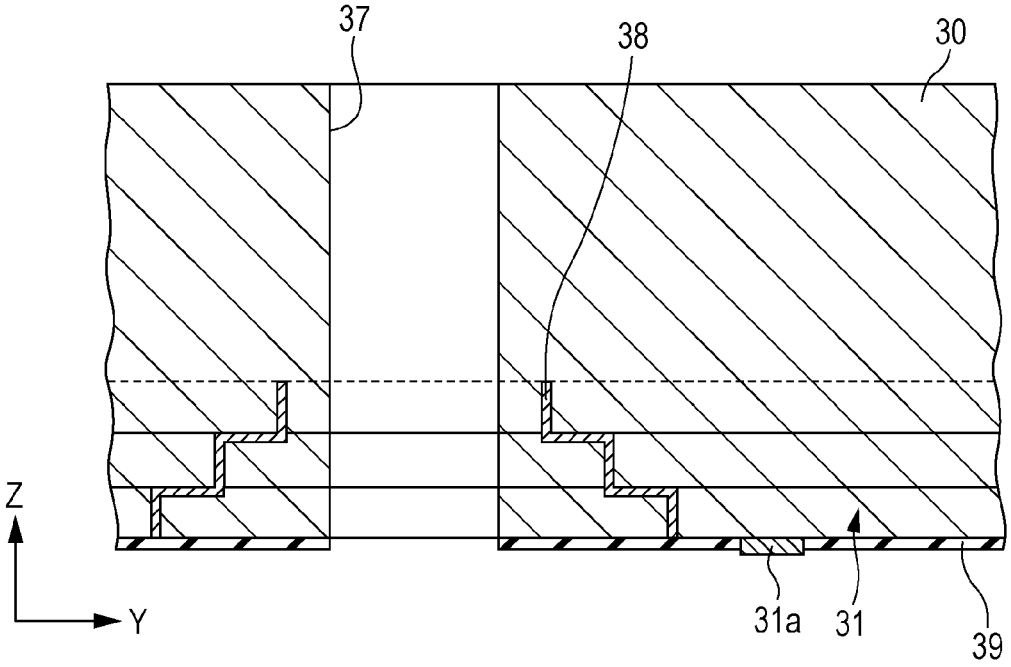
FIG. 7 is a sectional view illustrating a main portion of the driving circuit board according to Embodiment 1.

Meanwhile, in a case where the atmosphere open passage 37 is provided on the driving circuit board 30, the moisture contained in the environment atmosphere flows into the driving circuit 31 side via the atmosphere open passage 37, which causes malfunction or destruction of the driving circuit 31. For this reason, in the embodiment, as illustrated in FIG. 7, a metal wiring 38, a so-called guard ring, is provided over the periphery of the atmosphere open passage 37 in at least a portion, in which the driving circuit 31 is provided, in the driving circuit board 30. When the metal wiring 38 is provided in the driving circuit board 30, the moisture contained in the environment atmosphere is prevent form entering flowing into the driving circuit 31 side via the atmosphere open passage 37 so as to suppress the malfunction or destruction of the driving circuit 31. In addition, in order to prevent the driving circuit 31 from being destroyed due to the moisture or the like, the metal wiring 38 is not necessarily provided, for example, a protective film such as a silicon nitride having resistance to the humidity or moisture may be provided over the inner surface of the atmosphere open passage 37. Meanwhile, the protective film 39 having resistance to the humidity is provided on the surface side facing the channel formation substrate 10 of the driving circuit board 30, and portions other than a terminal 31*a* are covered with the protective film 39, and thus it is possible to prevent the driving circuit 31 from being destroyed due to the moisture. Needless to say, the metal wiring 38 may be continuously provided over the driving circuit board 30 in the third direction Z which is the thickness direction.

In addition, a method of connecting the external wiring to the driving circuit board 30 is not particularly limited. For example, the through electrode is provided on the driving circuit board 30, and then the external wiring may be connected to the through electrode on the surface of the driving circuit board 30, which is opposite to the surface facing the channel formation substrate 10. In addition, on the surface of the driving circuit board 30, which is opposite to the surface facing the channel formation substrate 10, the wiring and the external wiring may be connected to each other on the outside of the holding portion 36 by providing the wiring from an area in which the driving circuit 31 is formed to the outside of the holding portion 36.

In this way, in the embodiment, the driving circuit 31 and the piezoelectric actuator 300 can be electrically connected to each other by directly bonding the driving circuit board 30, on which the driving circuit 31 is formed, to the channel formation substrate 10, and thus, it is possible to reliably connect the piezoelectric actuator 300 which is disposed at high density and the driving circuit 31 with low cost.

A case member 40 which forms the manifold 100 communicating with the plurality of pressure generating chambers 12 is fixed to a bonding body formed of the channel formation substrate 10, the driving circuit board 30, the communicating plate 15, and the nozzle plate 20. The case member 40 is formed into the substantially the same shape as that of the communicating plate 15, and is bonded to the driving circuit board 30 and the aforementioned communicating plate 15. Specifically, the case member 40 includes a recessed portion 41 having a depth for accommodating the channel formation substrate 10 and the driving circuit board 30 on the driving circuit board 30 side. The recessed portion 41 includes an opening area larger than the surface of the driving circuit board 30, which is bonded to the channel formation substrate 10. In addition, in a state where the channel formation substrate 10 and the like are accommodated in the recessed portion 41, the opening surface of the recessed portion 41 on the nozzle plate 20 side is sealed by the communicating plate 15. In addition, the case member 40 is provided with a third manifold portion 42 having a recessed shape on both sides of the recessed portion 41 in the second direction Y. The third manifold portion 42, the first manifold portion 17 provided on the communicating plate 15, and the second manifold portion 18 constitute the manifold 100 of the embodiment.

As a material of the case member 40, for example, a resin or metal can be used. In addition, when a resin material is molded as the case member 40, it can be mass-produced at low cost.

In addition, the compliance board 45 is provided on the surface to which the first manifold portion 17 and the second manifold portion 18 of the communicating plate 15 are opened. The compliance board 45 seals the openings of the first manifold portion 17 and the second manifold portion 18 on the liquid ejection surface 20*a* side. Such a compliance board 45 is provided with a sealing film 46 and a fixing substrate 47 in the embodiment. The sealing film 46 is formed of a thin film having flexibility (for example, a thin film having a thickness of 20 μm or less, which is formed of polyphenylene sulfide (PPS), the stainless steel (SUS), or the like), and the fixing substrate 47 is formed of a hard material formed of metal such as the stainless steel (SUS). The area of the fixing substrate 47 which faces the manifold 100 becomes an opening portion 48 which is completely removed in the thickness direction, and thus one surface of the manifold 100 becomes a compliance portion 49 which is a flexible portion sealed by only the sealing film 46 having flexibility.

The case member 40 is provided an induction path 44 which communicates with the manifold 100 so as to supply ink to each of the manifolds 100. In addition, the case member 40 is provided with a connection port 43 to which the surface of the driving circuit board 30 on the side opposite to the channel formation substrate 10 is exposed and into which an external wiring (not shown) is inserted, and the external wiring inserted into the connection port 43 is connected to the driving circuit board 30. In the embodiment, the connection port 43 into which the external wiring is inserted is provided in an area facing the atmosphere open passage of the driving circuit board 30, and communicates with the atmosphere open passage 37. With this, the atmosphere open passage 37 communicates with the outside of the case member 40 via the connection port 43.

In the ink jet recording head 1 having such a configuration, at the time of ejecting the ink, the inside of channel from the manifold 100 to the nozzle 21 is filled with the ink from a liquid storage portion for storing ink via an induction path 44. Thereafter, in response to a signal from the driving circuit 31, the voltage is applied to each of the piezoelectric actuator 300 corresponding to the pressure generating chamber 12, and thus the piezoelectric actuator 300 and the vibrating plate 50 are deformed to be bent. With this, the pressure in the pressure generating chamber 12 is increased and an ink droplet is ejected from a predetermined nozzle 21.

Other Embodiments

As described, the respective embodiments of the invention is described; however, a basic configuration of the invention is not limited.

In the above-described Embodiment 1, the bump 32 is provided on the driving circuit board 30; however, the invention is not necessarily limited to such a configuration. The bump 32 may not be provided on the channel formation substrate 10 side. In addition, regarding the individual wiring 91 and the common 92 on the channel formation substrate 10 on which the bump 32 and the adhesive layer 35 are provided, for example, the piezoelectric layer 70 of the piezoelectric actuator 300 is provided, and then the individual wiring 91 and the common 92 may be provided on the piezoelectric layer 70. With this, it is possible to secure the height of the holding portion 36 between the driving circuit board 30 and the channel formation substrate 10 in the third direction Z without provided a recessed portion or the like on the driving circuit board 30, and to prevent the piezoelectric actuator 300 from coming in contact with the driving circuit board 30 at the time of the displacement of the piezoelectric actuator 300. In addition, the size of the bump 32 and the width of the adhesive layer 35 are not required to be largely formed in order to secure the height of the holding portion 36, and thus it is possible to realize the cost reduction and the size reduction by reducing an area for installing the bump 32 and the adhesive layer 35.

In addition, in the above-described Embodiment 1, as the bump 32, the core portion 33 a resin material having elastic properties and the metallic film 34 which is provided on the surface of the core portion 33 are used; however, the invention is not limited thereto. For example, as the bump 32, a metallic bump such as a solder or gold (Au), that is, the metallic bump may be used for the inner core portion. When the metallic bump is used as the bump 32, it is difficult to elastically deform the metallic bump. Therefore, the connection between the metallic bump and the individual wiring 91 and the common wiring 92 may be performed through soldering or brazing, eutectic bonding, welding, or bonding by using a conductive adhesive containing conductive particles (ACP or ACF) and a non-conductive adhesive (NCP or NCF). Meanwhile, in a case where the individual wiring 91 is disposed at a high density in accordance with the piezoelectric actuator 300 at high density, it is difficult to bond the individual wiring 91 and the bump 32 through the soldering, and thus it is preferable that the individual wiring 91 and the bump 32 are directly bonded to each other or are bonded to each other by using the conductive adhesive or the non-conductive adhesive. Here, in a case where warpage or undulation occurs on the channel formation substrate 10 or the driving circuit board 30, the metallic bump is not easily deformed in accordance with the warpage or undulation. Thus, it is likely that the connection failure occurs as compared with the bump 32 using the core portion 33 made of a resin having elastic properties as in the Embodiment 1 described above.

Further, in the above-described Embodiment 1, the first electrode 60 is set to be the individual electrode in each of the active portions, and the second electrode 80 is set to be the common electrode of the plurality of active portions; however, the invention is not limited thereto. For example, the first electrode may be set to be the common electrode of the plurality of active portions, and the second electrode may be set to be the individual electrode in each of the active portions. In addition, in the above-described Embodiment 1, the vibrating plate 50 is formed of the elastic film 51 and the insulator film 52; the invention is not particularly limited thereto. For example, the vibrating plate 50 may include any one of the elastic film 51 and the insulator film 52, and the vibrating plate 50 may include other films. In addition, the vibrating plate 50 may serve as the vibrating plate only with the first electrode 60, without providing the elastic film 51 and the insulator film 52. Further, the piezoelectric actuator 300 may substantially serve as the vibrating plate.

In addition, in the above-described Embodiment 1, the driving circuit is provided on the surface of the driving circuit board 30, which is opposite to the surface facing the channel formation substrate 10; however, the invention is not limited thereto. For example, the driving circuit may be provided on the surface of the driving circuit board 30, which is opposite to the surface facing the channel formation substrate 10. In this case, regarding the bump and the driving circuit, a through electrode which is provided by passing through the driving circuit board 30 in the third direction Z which is the thickness direction, for example, a silicon through electrode (TSV) is provided such that the driving circuit and the bump are connected to each other via the through electrode.

In addition, in the above-described Embodiment 1, the driving circuit board 30 which is provided with the driving circuit 31 formed through a semiconductor process; however, the invention is not limited thereto. For example, the driving circuit board 30 may be not provided with a switching element such as a transmission gate. That is, the driving circuit board 30 may not be provided with the switching element, but may be provided with a wiring to which a driving circuit (IC) is connected. In other words, regarding the driving circuit board 30, the invention is not limited to the configuration that the driving circuit 31 is integrally formed through the semiconductor process.

Figure 8:
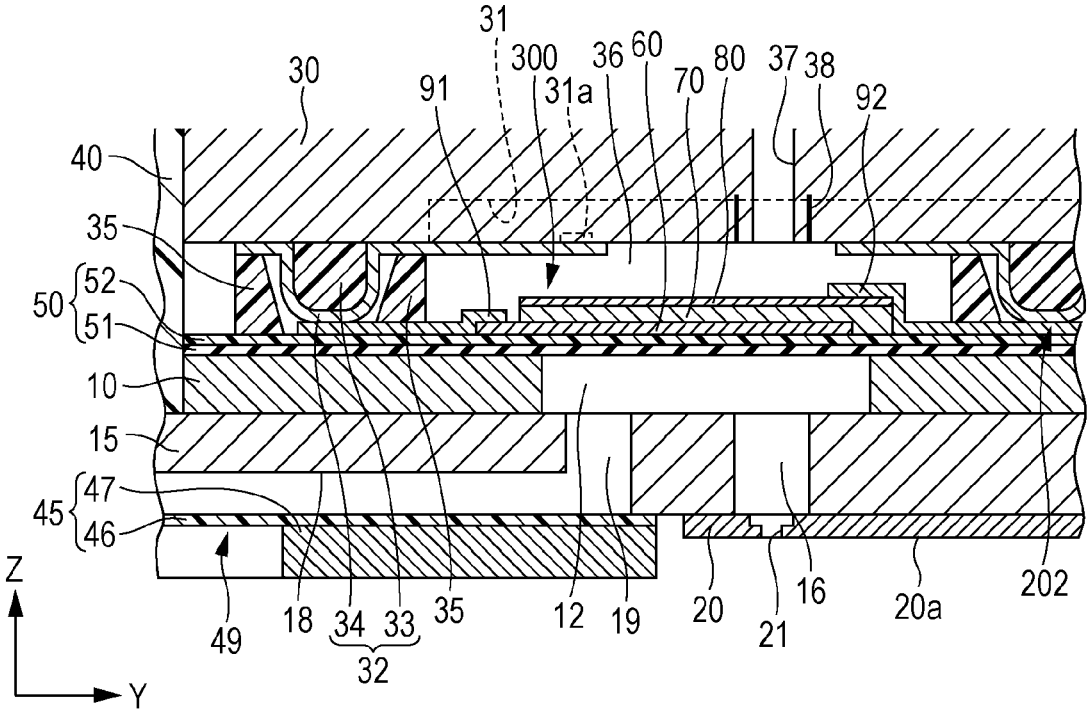
FIG. 8 is an enlarged sectional view illustrating a main portion of a head according to other embodiments.

In addition, in the above-described Embodiment 1, the adhesive layer 35 is provided to be the same width in the third direction Z; however, the invention is not particularly limited. Here, FIG. 8 illustrates other examples of the adhesive layer illustrate. In addition, FIG. 8 also illustrates Modification Example of the adhesive layer relating to other embodiments (an enlarged sectional view of a main portion).

As illustrated in FIG. 8, the adhesive layer 35 bonding the channel formation substrate 10 and the driving circuit board 30 overlap a portion of the bump 32 in a connecting direction of the bump 32, that is, in the third direction Z. Specifically, the width the adhesive layer 35 in the second direction Y extends to the extent that the connection between the bump 32 and the individual wiring 91 on the channel formation substrate 10 side is not disturbed. That is, in the embodiment, the adhesive layer 35 is formed into a trapezoid type in which the width of a cross-section, that is, the width of a sectional shape in the second direction Y is wide on the channel formation substrate 10 side, and is narrow on the driving circuit board 30 side. In this way, when the adhesive layer 35 and the bump 32 overlap with each other in the third direction Z, the adhesive area of the adhesive layer 35 is enlarged, and thus it is possible to enhance the bonding strength between the channel formation substrate 10 and the driving circuit board 30. In addition, in the embodiment, since a bonding area of the adhesive layer 35 is extended toward the bump 32 to the extent that the connection between the bump 32 and individual wiring 91 is not disturbed, it is possible to realize the size reduction as compared with a case where the adhesive layer 35 is extended to the side opposite to the bump 32. In addition, although not particularly illustrated in the drawings, the same configuration is applicable to the adhesive layer 35 in the common wiring 92, and thus it is possible to further enhance the bonding strength between the channel formation substrate 10 and the driving circuit board 30.

Further, in the above-described Embodiment 1, the adhesive layer 35 is also provided in both sides of the bump 32, which connects the driving circuit 31 and the common wiring 92, in the second direction Y; however, the invention is not limited thereto. For example, the adhesive layer 35 may not be provided on both sides of the bump 32 which is connected to the common wiring 92. Even such a case, in the above-described Embodiment 1, since the adhesive layer 35 is provided on both sides of the bump 32, which is connected to the individual wiring 91, the bump 32 and the common wiring 92 can be ensurely connected to each other without the adhesive layer 35 on both sides of the bump 32, which is connected to the common wiring 92, in the second direction Y.

Further, in the above-described Embodiment 1, the holding portion 36 is independently provided for each row of the piezoelectric actuator 300; however, the invention is not limited thereto, the holding portions 36 correspond to the respective rows of the piezoelectric actuator 300 may communicate with each other, or one holding portion 36 may be provided with respect to two rows of the piezoelectric actuator 300. In addition, the number of the atmosphere open passages 37 is not particularly limited. For example, the plurality of atmosphere open passages 37 may be provided with respect to one holding portion 36, or when two holding portions 36 communicate with each other, one atmosphere open passage 37 may be provided with respect to the communicating holding portions 36.

In addition, in the above-described Embodiment 1, the driving circuit 31 is integrally provided on both sides of the driving circuit board 30, which face the channel formation substrate 10; however, the invention is not limited thereto. For example, the driving circuit may be provided on the surface of the driving circuit board 30 opposite to the channel formation substrate 10. The driving circuit and the bump may be connected to each other via the through electrode passing through the driving circuit board in the third direction Z.

Further, in the above-described Embodiment 1, the driving circuit board 30 is formed into a flat shape such that the surface thereof on the channel formation substrate 10 becomes a flat surface; however, the invention is not limited thereto. For example, the recessed portion may be provided in an area facing the piezoelectric actuator 300 on the surface of the driving circuit board 30 on the channel formation substrate 10 side. With this, it is possible to prevent the piezoelectric actuator 300 from come in contact with the driving circuit board 30 at the time of the displacement of the piezoelectric actuator 300 by widening the gap between the piezoelectric actuator 300 and the driving circuit board 30. Meanwhile, the recessed portion may be formed on the driving circuit board 30 by scraping the driving circuit board 30, or a protrusion may be formed of a resin or formed by film formation such that the recessed portion is formed on the driving circuit board 30. In addition, when the recessed portion is formed by scraping the driving circuit board 30, it is difficult to integrally from the driving circuit 31 on the bottom surface of the recessed portion, and thus it is preferable that the driving circuit 31 is integrally formed on the surface of the driving circuit board 30 opposite to the channel formation substrate 10. In addition, one recessed portion may be commonly provided with respect to two rows of the piezoelectric actuator 300, or one recessed portion may be provided for each row of the piezoelectric actuator 300.

In addition, in the above-described Embodiment 1, one driving circuit board 30 is provided with respect to one channel formation substrate 10; however, the invention is not limited thereto. For example, the driving circuit board 30 may be independently provided for each row of the piezoelectric actuator 300. In this regards, as described Embodiment 1, when providing one driving circuit board 30 with respect to one channel formation substrate 10, it is possible to reduce the number of components, and the connection between the common wiring 92 and the driving circuit board 30 can be commonly performed on two rows of the piezoelectric actuator 300, thereby reducing the connection places. Accordingly, as described Embodiment 1, when providing one driving circuit board 30 with respect to one channel formation substrate 10, it is possible to reduce the cost.

Further, in the above-described Embodiment 1, the configuration in which two rows of the piezoelectric actuator 300 are provided in the second direction Y; however, the number of row of the piezoelectric actuator 300 is not particularly limited. For example, it may be one row, or three or more rows.

Figure 9:
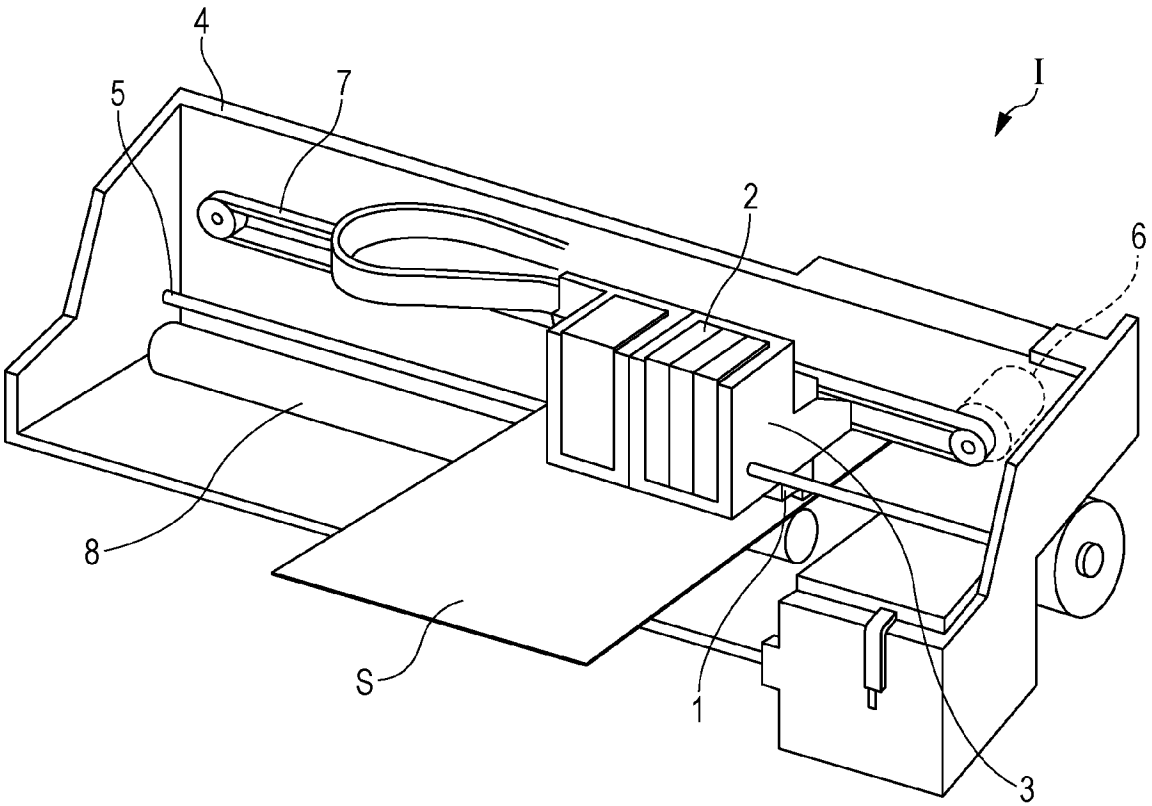
FIG. 9 is schematic diagram of a recording apparatus according to one embodiment.

In addition, the ink jet recording head 1 in these embodiments forms a portion of an ink jet recording head unit which is provided with an ink flow path communicating an ink cartridge or the like, and is mounted on the ink jet type recoding apparatus which is an example of the liquid ejecting apparatus. FIG. 9 is a schematic diagram illustrating an example of the ink jet type recoding apparatus.

In an ink jet type recoding apparatus I as illustrated in FIG. 9, the ink jet recording head 1 is provided with a detachable cartridge 2 forming a supply unit, and a carriage 3 which is mounted on the ink jet recording head 1 is provided to be freely movable in the axial direction of a carriage axis 5 attached to an apparatus main body 4.

In addition, when a driving force of a driving motor 6 is transferred to the carriage 3 via a plurality of gears (not shown) and the timing belt 7, the carriage 3 mounted on the ink jet recording head 1 is moved along the carriage axis 5. On the other hand, a transporting roller 8 is provided in the apparatus main body 4 as a transporting unit, and a recording sheet S which is a recording medium such as a sheet is transported by the transporting roller 8. Meanwhile, the transporting unit that transports the recording sheet S may be a belt or a drum without being limited to the transporting roller.

In addition, in the above-described ink jet type recoding apparatus I, the ink jet recording head 1 is mounted on the carriage 3 and moved in a main scanning direction; however, a configuration of the ink jet type recoding apparatus I is not particularly limited thereto. For example, a so-called line-type recording apparatus, which performs printing such that the ink jet recording head 1 is fixed and the recording sheet S such as a sheet is moved in a sub scanning direction, is applicable to the invention.

In addition, in the above-described example, the ink jet type recoding apparatus I has a configuration that the cartridge 2 which is a liquid storage portion is mounted on the carriage 3; however, a configuration of the ink jet type recoding apparatus I is not particularly thereto. For example, a configuration such that the liquid storage portion such as an ink tank is fixed to the apparatus main body 4, and the storage portion and the ink jet recording head 1 are connected to each other via a supply tube such as a tube may be employed. In addition, the liquid storage portion may not be mounted on the ink jet type recoding apparatus.

In addition, the invention relates to a broadly general head, for example, the invention is applicable to various types of ink jet recording heads used in an image recording apparatus such as a printer, a color material ejecting head used for manufacturing a color filter such as a liquid crystal display, an electrode material ejecting head used for forming electrodes such as such as an organic EL display and a field emission display (FED), and a bioorganic material ejecting head used to manufacture a bio chip.

What is claimed is:

1. A head comprising:

a channel formation substrate that is provided with a pressure generating chamber which communicates with a nozzle for ejecting a liquid;

a piezo element that is provided on one surface side of the channel formation substrate; and a driving circuit board that is bonded to the one surface side of the channel formation substrate via an adhesive layer, and is provided with a driving circuit for driving the piezo element, wherein the piezo element and the driving circuit are electrically connected to each other via a bump which is provided on any one of the channel formation substrate and the driving circuit board, wherein a holding portion which is surrounded by the adhesive layer and holds the piezo element therein is provided between the driving circuit board and the channel formation substrate, and wherein the holding portion is opened to an atmosphere through an atmosphere open passage which is provided to penetrate the driving circuit board in a direction in which the driving circuit board and the channel formation substrate are stacked, wherein the holding portion includes a first holding portion and a second holding portion, wherein the first holding portion, which is surrounded by the adhesive layer and holds the piezo element therein, is provided between the driving circuit board and the channel formation substrate, wherein the second holding portion, which is surrounded by the adhesive layer and holds the bump therein, is provided between the driving circuit board and the channel formation substrate, wherein the first holding portion is opened to the atmosphere through the atmosphere open passage.

2. The head according to claim 1, wherein a metal wiring is provided over the periphery of the atmosphere open passage in at least a portion in which the driving circuit is provided in the driving circuit board.

3. The head according to claim 1, wherein the adhesive layer is formed of a photosensitive resin.

4. The head according to claim 1, wherein the bump includes a core portion having elastic properties, and a metallic film which is provided on a surface of the core portion.

5. A liquid ejecting apparatus comprising the head according to claim 1.

6. A liquid ejecting apparatus comprising the head according to claim 2.

7. A liquid ejecting apparatus comprising the head according to claim 3.

8. A liquid ejecting apparatus comprising the head according to claim 4.

9. The head according to claim 1, wherein the bump is disposed between the driving circuit board and the channel formation substrate.

10. The head according to claim 1, wherein the atmosphere open passage configured to inhibit moisture from flowing into the holding portion.

* * * * *